US005643705A

United States Patent [19]

Inoue et al.

[11] Patent Number: 5,643,705

[45] Date of Patent: Jul. 1, 1997

[54] TONER FOR DEVELOPING ELECTROSTATIC IMAGE AND IMAGE FORMATION PROCESS USING THE TONER

[75] Inventors: Satoshi Inoue; Chiaki Suzuki; Tetsu Torigoe; Shuji Sato; Takahisa Fujii, all of Minami Ashigara, Japan

[73] Assignee: Fuji Xerox Co., Ltd., Tokyo, Japan

[21] Appl. No.: 540,025

[22] Filed: Sep. 28, 1995

[30] Foreign Application Priority Data

Sep. 30, 1994 [JP] Japan ..... 6-259808

[51] Int. Cl.[6] ..... G03G 9/087

[52] U.S. Cl. ..... 430/110; 430/124

[58] Field of Search ..... 430/110, 125, 430/124

[56] References Cited

U.S. PATENT DOCUMENTS

| | | | |
|---|---|---|---|
| 4,810,612 | 3/1989 | Ueda et al. | 430/110 |
| 4,921,771 | 5/1990 | Tomono et al. | 430/110 |
| 4,994,340 | 2/1991 | Yamazaki et al. | 430/110 |
| 5,244,765 | 9/1993 | Katoh et al. | 430/110 |

FOREIGN PATENT DOCUMENTS

| | | |
|---|---|---|
| 60-93457 | 5/1985 | Japan . |
| 60-93456 | 5/1985 | Japan . |
| 2-87159 | 3/1990 | Japan . |
| 4-30580 | 5/1992 | Japan . |
| 4-48227 | 8/1992 | Japan . |

OTHER PUBLICATIONS

English abstract of JP 60–93456. May 1985.
English abstract of JP 60–93457. May 1985.
English abstract of JP 60–23859. Feb 1985.
English abstract of JP 61–130957. Jun. 1986.

*Primary Examiner*—Christopher D. Rodee
*Attorney, Agent, or Firm*—Oliff & Berridge

[57] ABSTRACT

The present invention provides a toner for developing an electrostatic image which inhibits the filming of a wax on the development sleeve and photoreceptor to obtain a stable image. The present invention also provides a toner for developing an electrostatic image which provides a practically sufficiently wide fixing latitude. The present invention further provides an image formation process for forming a copied image with an excellent dot reproducibility, fine line reproducibility and gradation. A novel toner for developing an electrostatic image is provided, which comprises a particulate toner containing a polyolefin wax and a modified polyolefin wax, wherein the average diameter of wax particles dispersed in the particulate toner is not more than 0.5 μm and the amount of wax exposed on the surface of said particulate toner is from 40 to 65% by weight. The particulate toner may comprise a finely divided magnetic powder in an amount of from 30 to 70% by weight. The content of modified polyolefin wax in the particulate toner is preferably greater than that of polyolefin wax.

7 Claims, No Drawings

TONER FOR DEVELOPING ELECTROSTATIC IMAGE AND IMAGE FORMATION PROCESS USING THE TONER

FIELD OF THE INVENTION

The present invention relates to a toner for developing an electrostatic image and more particularly to a magnetic toner comprising one component or two components and an image formation process using such a toner. The present invention further relates to a toner suitable for use in an image forming apparatus comprising a means of coating a thin toner layer on a toner carrier while carrying said toner carrier until the development process, a heat fixing mechanism such as heat roll, and a means of cleaning a latent image carrier.

BACKGROUND OF THE INVENTION

As dry development processes used in various electrostatic duplicating processes which have been put into practical use there have been known a two-component(binary) development process using a toner and a carrier such as iron powder and a one-component(unitary) development process using a magnetic toner comprising a magnetic material incorporated therein free of carrier The unitary development process using a magnetic toner requires no automatic concentration adjustor as required in the developing machine used in the binary development process. Thus, the developing machine used in the unitary development process can be compact. Further, since no carrier stain occurs, no maintenance such as replacement of carrier is required. Accordingly, the unitary development process has been used not only in low speed small-sized duplicating machines or printers but also in middle or higher speed duplicating machines, printers or plotters. Thus, further enhancement of properties have been desired in the unitary development process.

On the other hand, the binary development process employs a carrier which serves to agitate, carry and charge the developer separately of the developer and thus has a good controllability. Therefore, the binary development process has been widely employed. In particular, a developer comprising a resin-coated carrier is advantageous in that it has a good charge controllability and can attain relatively easy enhancement of environmental dependence and age stability.

In recent years, digitization has gone a long way in the field of printer as well as in the field of duplicating machine, making it possible to form a latent image more precisely, in particular, a minute difference in gradation with small kanji (Chinese character) or dots can be expressed. On the other hand, a plotter for a large-size drawing employing a magnetic unitary development process to produce a reduced sized plotter has been developed, A drawing is mainly composed of lines, and thus it is important to faithfully and stably reproduce the width of these lines. Digitization has made possible to form a latent image precisely. Thus, studies have been made on the faithful development of the high precision latent image.

As mentioned above, the magnetic unitary development process has various advantages. However, the magnetic unitary development process has essential problems from the standpoint of high image-quality development. In other words, the particulate toner undergoes magnetic agglomeration due to the magnetic material contained therein during development. Thus, the particulate toner seemingly increases in size, making it difficult to faithfully develop the latent image. This is a disadvantage which is not encountered in the binary development toner free of magnetic material.

The magnetic toner is also disadvantageous from the standpoint of fixability. In other words, the magnetic toner comprises a large amount of a magnetic material which cannot be fixed and thus is inevitably inferior to the non-magnetic toner. Further, a magnetic toner which can be fixed with a lower energy has been desired.

On the other hand, a particulate toner comprising a polyolefin wax incorporated therein has frequently been used to eliminate various disadvantages in fixing properties such as offset in which the toner is attached to a heat roll used in the heat roll fixing process, causing stain on subsequent duplicating papers, smudge in which the fixed toner image is partially destroyed and transferred to a white paper when rubbed with the white paper and finger mark in which the fixed image is destroyed by a finger for peeling a paper which has been passed through a heat roll. The particulate toner comprising a polyolefin wax incorporated therein has a good releasability from the heat roller and hence a good offset resistance. However, since such a polyolefin wax has a poor compatibility with a binder resin, it forms a large domain in the binder resin. Thus, the toner can be easily destroyed at the domain portion during preparation, causing the wax to be exposed on the surface of the particulate toner. If such a toner is used in the magnetic unitary development process, the polyolefin wax migrates to the development sleeve and photoreceptor, causing the toner to be unevenly carried or the photoreceptor to be stained and hence causing density drop or image quality deterioration.

In the binary toner, too, a polyolefin wax is drastically exposed on the surface of the particulate toner. The polyolefin wax can migrate to the carrier or photoreceptor, causing density drop, toner scattering and image quality deterioration.

In order to eliminate such a secondary hindrance caused by polyolefin wax, an approach has been proposed which comprises specifying the amount of wax exposed on the surface of the toner as disclosed in JP-A-2-87159 (The term "JP-A" as used herein means an "unexamined published Japanese patent application"). However, this approach is disadvantageous in that the exposure of the domain of polyolefin wax cannot be thoroughly eliminated, making it impossible to eliminate the uneven toner distribution over the development sleeve. This rather worsens the offset resistance and deteriorates the fixability of the toner.

Attempts have heretofore been made to reduce the minimum dispersible diameter of polyolefin wax particles. For example, the use of a modified polyolefin wax has been proposed. JP-B-4-48227 (The term "JP-B" as used herein means an "examined Japanese patent publication") discloses the use of a modified polyolefin obtained by grafting a polyolefin with an unsaturated dicarboxylic ester. JP-B-4-30580 discloses the use of a modified polyethylene obtained by the block copolymerization of a polyethylene with an acrylate monomer made of acrylic ester or methacrylic ester. If only a modified polyolefin wax is used, the wax domain diameter is reduced. However, the resulting effect of raising the offset temperature is smaller than that of polyolefin wax. Thus, the added amount of the modified polyolefin wax needs to be increased. As a result, the amount of wax exposed on the surface of the particulate toner is increased, deteriorating the developability of the toner. Thus, no toners which can satisfy both the requirements for offset resistance and resistance to stain on the development sleeve have been found.

The combined use of a modified olefin wax and an olefin wax has been proposed in this respect as disclosed in JP-A-60-93456 and JP-A-60-93457. However, the effect of reducing the wax domain diameter is lessened depending on the mixing ratio of the modified olefin wax. This approach is also disadvantageous in that when the total amount of the two waxes based on the weight of the toner is increased, the amount of wax particles exposed on the surface of the particulate toner is increased, causing the wax to migrate to the development sleeve.

SUMMARY OF THE INVENTION

It is therefore an object of the present invention to provide a toner for developing an electrostatic image which inhibits the filming of a wax on the development sleeve and photoreceptor to obtain a stable image.

It is another object of the present invention to provide a toner for developing an electrostatic image which provides a practically sufficiently wide fixing latitude.

It is a further object of the present invention to provide a toner for developing an electrostatic image excellent in dot reproducibility and fine line reproducibility.

It is a further object of the present invention to provide a toner for developing an electrostatic image which can faithfully reproduce a digital latent image with an excellent gradation.

It is a still other object of the present invention to provide an image formation process for forming a copied image with excellent dot reproducibility, fine line reproducibility and gradation.

These and other objects of the present invention will become more apparent from the following detailed description and examples.

The toner for developing an electrostatic image of the present invention comprises a particulate toner containing a polyolefin wax and a modified polyolefin wax, wherein the average diameter of wax particles dispersed therein is not more than 0.5 μm and the amount of wax exposed on the surface of said particulate toner is from 40 to 65% by weight.

The image formation process of the present invention comprises a step of forming an electrostatic latent image on a latent image carrier, a step of developing said electrostatic latent image with a developer, a step of transferring a toner image thus formed onto a transfer medium, and a step of heat-fixing said toner image on said transfer medium, characterized in that said developer comprises a particulate toner containing a polyolefin wax and a modified polyolefin wax, wherein the average diameter of wax particles dispersed in said particulate toner is not more than 0.5 μm and the amount of wax exposed on the surface of said particulate toner is from 40 to 65% by weight.

DETAILED DESCRIPTION OF THE INVENTION

The toner for developing an electrostatic image of the present invention will be described hereinafter. The toner developing an electrostatic image of the present invention can be applied to a magnetic unitary development process when it contains a magnetic powder. When the magnetic powder is free, it can be applied to a binary development process.

The toner for developing an electrostatic image of the present invention comprises a particulate toner containing a coloring agent and/or a finely divided magnetic powder incorporated in a binder resin and containing a polyolefin wax and a modified polyolefin wax dispersed in said binder resin.

As the binder resin employable in the present invention there may be used a known synthetic or natural resin. For example, a polymer or copolymer of one or more vinyl monomers may be used. Representative examples of the vinyl monomer include styrene, p-chlorostyrene, and vinyl naphthalene. Examples of these vinyl monomers include ethylenically unsaturated monoolefins such as ethylene, propylene, butylene and isobutylene; vinyl esters such as vinyl chloride, vinyl bromide, vinyl fluoride, vinyl acetate, vinyl propionate, vinyl benzoate, vinyl formate, vinyl stearate and vinyl caproate; ethylenically mono-carboxylic acids and esters thereof such as methyl acrylate, ethyl acrylate, n-butyl acrylate, isobutyl acrylate, dodecyl acrylate, n-octyl acrylate, 2-chloroethyl acrylate, phenyl acrylate, methyl-α-chloroacrylate, methyl methacrylate, ethyl methacrylate and butyl methacrylate; ethylenically monocarboxylic acid-substituted compounds such as acrylonitrile, methacrylonitrile and acrylamide; ethylenically carboxylic acids and esters thereof such as dimethyl maleate, diethyl maleate and dibutyl maleate, vinyl ketones such as vinyl methyl ketone, vinyl hexyl ketone and methyl isopropenyl ketone, vinyl ethers such as vinyl methyl ether, vinyl isobutyl ether and vinyl ethyl ether, vinylidene halides such as vinylidene chloride and vinylidene chlorofluoride; and N-vinyl compounds such as N-vinylpyrrole, N-vinylcarbazole, N-vinylindole and N-vinylpyrrolidone.

As the coloring agent there may be used any known coloring agent which can be used for toners.

Examples of the finely divided magnetic powder to be dispersed in the binder resin of the present invention include known magnetic materials such as metal (e.g., iron, cobalt, nickel) and alloy thereof; metal oxide (e.g., $Fe_3O_4$, $\gamma$-$Fe_2O_3$, cobalt-added iron oxide; various ferrites (e.g., MnZn ferrite, NiZn ferrite); magnetite; and hematite. These magnetic materials may be processed with a surface treatment such as silane coupling agent and titanate coupling agent or coated with a polymer. The mixing proportion of such a finely divided magnetic powder is preferably from 30 to 70% by weight, more preferably from 35 to 65% by weight based on the total weight of the particulate toner. If the mixing proportion of such a finely divided magnetic powder falls below 30% by weight, the toner carrier exhibits a reduced magnetic force for binding the toner, causing the toner to fly away. On the contrary, if the mixing proportion of such a finely divided magnetic powder exceeds 70% by weight, reproducibility in the density is reduced. The magnetic powder preferably has an average grain diameter of from 0.05 to 0.5 μm to have a good dispersibility.

As the polyolefin wax to be dispersed in the binder resin there may be preferably used a low molecular weight polyethylene or low molecular weight polypropylene having a softening point of from 80° C. to 160° C. and a number average molecular weight (Mn) of from about 1,000 to about 10,000.

As the modified polyolefin wax there may be preferably used a wax mainly composed of polyethylene. The synthesis of the modified polyolefin wax can be accomplished by, e.g., the polymerization of vinyl monomers as modifying components in the presence of polyethylene. Examples of the modifying components employable in the synthesis of the modified polyolefin wax include aromatic vinyl monomers such as phenylpropene, styrene, methylstyrone and ethylstyrone; acrylate monomers made of ester acrylate or ester methacrylate such as methyl acrylate, ethyl acrylate, n-butyl acrylate, lauryl acrylate, stearyl acrylate, methyl methacrylate, ethyl methacrylate, n-butyl methacrylate, lauryl methacrylate and stearyl methacrylate; and unsaturated dicarboxylic acid ester, such as ethyl maleate, butyl maleate, ethyl fumarate and dibutyl fumarate. In the modification of the polyolefin wax, the percent modification is preferably from 3 to 50% by weight, more preferably from 5 to 30% by weight based on the weight of the polyolefin wax. If the percent modification falls below 3% by weight, the effect of reducing the minimum dispersible wax diameter is lessened, resulting in the migration of the wax to the toner. On the contrary, if the percent modification exceeds 30% by weight, fixing defects such as hot offset and finger mark can occur. The modified polyolefin wax preferably has a softening point of from 80° C. to 160° C. and a number average molecular weight (Mn) of from 1,000 to 15,000.

In the present invention, if the foregoing polyolefin wax and modified polyolefin wax are incorporated in the particulate toner, it is necessary that the average grain diameter of wax dispersed in the particulate toner be not more than 0.5 μm. If the average grain diameter of wax dispersed in the particulate toner exceeds 0.5 μm, the toner can be easily crushed in the domain of the wax during its preparation, causing a rise in the exposed amount of wax. Thus, the wax present on the surface of the particulate toner can migrate to the development sleeve or photoreceptor. Examples of the method for controlling the average grain diameter of wax dispersed in the particulate toner include a method for controlling in production and a method for controlling in material. An example of the former controlling method is to control the kneading conditions or the conditions of heat treatment of particulate toner. An example of the latter controlling method is to control the mixing ratio of polyolefin wax and modified polyolefin wax, the percent modification of modified polyolefin wax, etc.

In the present invention, the exposed amount X (% by weight) of wax on the surface of the particulate toner needs to satisfy the relationship $40 \leqq x \leqq 65$. If the exposed amount X of wax on the surface of the particulate toner falls below 40% by weight, hot offset, finger mark or the like can occur, reducing the fixability of the toner. On the contrary, if the exposed amount X of wax on the surface of the particulate toner exceeds 65% by weight, it causes the wax to migrate to the development sleeve. An example of method for controlling the exposed amount of wax on the surface of the particulate toner is to control the added amount of wax, the minimum dispersible wax diameter or the kneading conditions or to post-treat the surface of the particulate toner. For instance, the exposed amount of wax is decreased by controlling the temperature at kneading to be lower than a melting point Of the wax, e.g., 140° C. or less, and more preferably 130° C. or less of the kneading temperature. The exposed amount of wax is controlled by changing a modified percent in the modified wax, e.g., 5 to 50% by weight and more preferably 10 to 40% by weight of the modified percent.

In the present invention, the mixing ratio of polyolefin wax and modified polyolefin wax preferably satisfies the relationship $WH \geqq WP$ wherein WP (% by weight) is the content of polyolefin wax and WH (% by weight) is the content of modified polyolefin wax. The content of polyolefin wax is preferably from 0.1 to 10% by weight, more preferably from 0.5 to 7% by weight and most preferably from 1 to 5% by weight, and modified polyolefin wax is preferably from 0.5 to 15% by weight, more preferably from 0.8 to 10% by weight, and most preferably from 1 to 8% by weight.

The total amount of wax contained in the particulate toner depends on a degree of modification, and preferably 0.6 to 25% by weight, more preferably 1 to 20% by weight and most preferably 2 to 15% by weight based on the total weight of the particulate toner.

If the added amount of polyolefin wax is greater than that of modified polyolefin wax, the effect of reducing the minimum dispersible wax diameter is lessened, cause a rise in the diameter of wax dispersed in the particulate toner. Thus, such a domain is exposed on the surface of the particulate toner, causing the toner to be unevenly carried over the development sleeve.

In the present invention, the foregoing particulate toner may contain various substances for the purpose of controlling chargeability, electrical resistance, etc. Examples of these substances include fluorine surface active agents, salicylic acid, chromium dyes such as chromium complex, high molecular acids such as copolymer comprising maleic acid as a monomer component, quaternary ammonium salts, azine dyes such as nigrosine, and carbon black.

The particulate toner of the present invention can be prepared by hot-kneading the foregoing binder resin with a coloring agent, a finely divided magnetic powder, a polyolefin wax, a modified polyolefin wax and other components, and then cooling, dispersing and classifying the mixture. In this process, the heating, agitation and other conditions are properly predetermined such that the average diameter of wax dispersed in the resulting particulate toner and the exposed amount of wax on the surface of the particulate toner fall within the above specified ranges.

The toner for developing an electrostatic image of the present invention may comprise finely divided particles of inorganic materials such as silica and titania incorporated in the toner as external additives for the purpose of enhancing the fluidity or chargeability of the particulate toner. The finely divided particles of inorganic materials preferably have a primary particle diameter of from 5 nm to 50 nm. The finely divided particles of inorganic materials may be subjected to surface treatment such as hydrophobic treatment.

The particulate toner may further comprise a particulate abrasive. Examples of the particulate abrasive employable herein include inorganic metal oxide, nitride, carbide, metal sulfate and metal carbonate having a Mohs' hardness of not less than 3, Specific examples of these particulate abrasives include metal oxides such as $SrTiO_3$, $CeO_2$, CrO, $Al_2O_3$ and MgO, nitride such as $Si_3N_4$, carbide such as SiC, and metal sulfate or metal carbonate such as $CaSO_4$, $BaSO_4$ and $CaCO_3$. These particulate abrasives may be treated with a surface treatment such as silane coupling agent and titanate coupling agent or may be coated with a polymer.

In order to use the toner for developing an electrostatic image of the present invention in the binary development process, a carrier is used. As such a carrier there may be used a magnetic powder-dispersed carrier comprising a binder resin and a magnetic powder, or a coated carrier.

The foregoing magnetic powder-dispersed carrier preferably exhibits an average particle diameter of from 20 to 150 μm and a volume resistivity of from $10^{10}$ to $10^{16}$ Ω·cm. As the binder resin there may be used any binder resin described with reference to the particulate toner. As the magnetic powder there may be used any particulate ferromagnetic material which has been commonly used, Specific examples of the particulate ferromagnetic material include various ferrites such as $Fe_3O_4$, MnZn ferrite and NiZn ferrite, chromium oxide, and various metal powder. Further, a chargeability controller or the like may be incorporated in the carrier as necessary. The amount of magnetic powder to be incorporated in the carrier is from 30 to 95% by weight, preferably from 45 to 90% by weight based on the total weight of the carrier. The preparation of the magnetic powder-dispersed carrier can be accomplished by kneading, grinding and classifying the foregoing components or by dissolving the foregoing components in a proper solvent or heating the foregoing components so that they are liquefied, and then subjecting the material to spray drying so that it is granulated.

The coated carrier comprises a magnetic core coated with a resin film. The coated carrier preferably exhibits an average particle diameter of from 40 to 200 μm and a volume resistivity of from $10^8$ to $10^{16}$ Ω·cm. As the magnetic core there may be used any particulate ferromagnetic material which can be commonly used. Specific examples of the ferromagnetic material include various ferrites such as $Fe_3O_4$, $\gamma$-$Fe_2O_3$, MnZn ferrite and NiZn ferrite, and chromium oxide. Examples of the resin with which the magnetic core is coated include polyfluorovinylidene, vinylidene fluoride-trifluoroethylene copolymer, vinylidene fluoride-hexafluoropropylene copolymer, acrylate polymer or copolymer thereof, and methacrylate polymer or copolymer thereof. The amount of such a resin to be used is normally from 0.05 to 3.0% by weight based on the weight of the magnetic core. The application of the resin to the magnetic core can be accomplished by any ordinary method, e.g., by adding a solution of the resin in an organic solvent to the magnetic core, and then subjecting the mixture to processing by a fluidized bed coating apparatus.

The particle diameter of the particulate toner as defined herein is determined by a Type TA-11 particle size meter (available from Coal Tar Counter Inc.; aperture diameter: 100 μm).

In order to determine the average diameter of wax particles dispersed in the toner, the toner is photographed by a transmission electron microscope at a 9,000× magnification. Measurements are taken at random from the photograph. These measurements are then averaged.

The amount of wax exposed on the surface of the particulate toner can be determined as follows. The proportion of number of elements present on the surface layer of the particulate toner (within the depth of 5 nm) is determined by ESCA (XPS) (available from Nihon Denshi K.K.). The proportion of elements in the various components constituting the toner such as binder resin, wax and magnetic powder is then determined. From these measurements, the amount of wax present on the surface of the particulate toner by weight proportion is determined.

The process for the formation of an image with the foregoing toner for developing an electrostatic image of the present invention will be described hereinafter. The image formation process of the present invention comprises a step of forming an electrostatic latent image on a latent image carrier, a step of developing said electrostatic latent image with a developer, a step of transferring the toner image thus formed onto a transfer medium, and a step of heat-fixing the toner image on the transfer medium. The formation of an electrostatic latent image on the latent image carrier can be effected by any known method. As such a latent image carrier there may be used an electrophotographic photoreceptor or dielectric material. For example, an electrophotographic photoreceptor, if used as the latent image carrier, can be uniformly charged, and then imagewise exposed to light to form an electrostatic latent image.

The electrostatic latent image thus formed is then developed at a step of developing an electrostatic latent image with a developer on a developer carrier. In the present invention, as such a developer there may be used one comprising the foregoing toner for developing an electrostatic image. It may be supplied onto the developer carrier with, e.g., a layer controlling member in such a manner that a thin layer is formed. The thin developer layer thus formed on the developer carrier is then opposed to the foregoing latent image carrier. In this manner, the electrostatic development toner thus charged is attached to the electrostatic latent image on the latent image carrier so that the electrostatic latent image is developed. The toner image thus formed is then transferred to a transfer medium such as paper by an ordinary method. The image thus transferred is then processed at a fixing step; e.g., passed through a heat roll and a press roll, so that it is heat-fixed.

The use of a particulate toner having a reduced diameter makes the scattering of toner, fogging, etc. less remarkable and makes it possible to reproduce fine lines faithfully. In this manner, a high image quality can be obtained. On the other hand, the surface of the particulate toner is increased by reducing a diameter of the toner particle. In the case of a toner comprising a polyolefin wax, the amount of wax exposed on the surface of the particulate toner is generally increased, making it easy to cause the filming of the polyolefin wax on the development sleeve, photoreceptor or carrier if the toner is applied to a unitary development process or binary development process. This causes the toner to be unevenly carried or stains the photoreceptor or carrier, resulting in the reduction of density or image defect. Since a polyolefin wax exhibits a poor compatibility with a binder resin, it forms a domain. The domain is exposed on the surface of the particulate toner, worsening the secondary hindrance. However, if the added amount of wax is reduced to reduce the exposed amount of wax, the fixability of the toner is impaired, causing smudge, offset, etc.

In the present invention, the average diameter of polyolefin wax and modified polyolefin wax to be dispersed in the particulate toner is controlled to fall within the above specified range. Further, the amount of wax on the surface of the particulate toner is controlled to fall within the above specified range. Moreover, the mixing ratio of polyolefin wax and modified polyolefin wax is controlled to fall within the above specified range. In this arrangement, even if a particulate toner having a reduced diameter comprising a wax is used, the wax doesn't migrate to a charging member such as development sleeve and a photoreceptor and the fixing latitude can be practically sufficiently increased.

The present invention will be further described hereinafter, but the present invention should not be construed as being limited thereto.

EXAMPLE 1

| | |
|---|---|
| Styrene-butylacrylate copolymer (copolymerization ratio: 80:20; Mw: 130,000; MI: 14; Tg: 59° C.) | 44.3 parts by weight |
| Magnetic material (hexahedral magnetite; average particle diameter: 0.19 μm) | 50 parts by weight |
| Negative charge controller (azo Cr dye) | 0.7 parts by weight |
| Low molecular weight polypropylene (softening point: 148° C.) | 2 parts by weight |
| Styrene-modified polyethylene (percent modification: 30% by weight; softening point: 126° C.) | 3 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.5 μm. The ground matter was then classified to obtain a classified product having $D_{50}$ of 7.3 μm and a particle diameter distribution in which particles having a particle diameter of not more than 5 μm account for 30% of all the particles by number. The average diameter of wax particles dispersed in the particulate toner was 0.3 μm. The amount of wax exposed on the surface of the particulate toner was 58% by weight. To the toner thus obtained was then added a colloidal silica (R972, available from Nihon Aerogel Co., Ltd.) in an amount of 1.0 part by weight based on 100 parts by weight of the toner with stirring by a Henschel mixer to obtain a toner 1.

EXAMPLE 2

| | |
|---|---|
| Styrene-butylacrylate copolymer (copolymerization ratio: 80:20; Mw: 125,000; MI: 11; Tg: 60° C.) | 47 parts by weight |
| Magnetic material (octahedral magnetite; average particle diameter: 0.22 μm) | 45 parts by weight |
| Negative charge controller (salicylic Cr dye) | 2 parts by weight |
| Low molecular weight polypropylene (softening point: 153° C.) | 2 parts by weight |
| Styrene-modified polyethylene (percent modification: 30% by weight; softening point: 120° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 7.6 μm. The ground matter was then classified to obtain a classified product having $D_{50}$ of 8.4 μm and a particle diameter distribution in which particles having a particle diameter of not more than 5 μm account for 15% of all the particles by number. The average diameter of wax particles dispersed in the particulate toner was 0.1 μm. The amount of wax exposed on the surface of the particulate toner was 64% by weight. To the toner thus obtained was then added a colloidal silica (R972, available from Nihon Aerogel Co., Ltd.) in an amount of 0.6 parts by weight based on 100 parts by weight of the toner with stirring by a Henschel mixer to obtain a toner 2.

EXAMPLE 3

| | |
|---|---|
| Styrene-butylacrylate copolymer (copolymerization ratio: 80:20; Mw: 130,000; MI: 14; Tg: 59° C.) | 44.3 parts by weight |
| Magnetic material (hexahedral magnetite; average particle diameter: 0.19 μm) | 50 parts by weight |
| Negative charge controller (azo Cr dye) | 0.7 parts by weight |
| Low molecular weight polypropylene (softening point: 148° C.) | 2 parts by weight |
| 1-Phenylpropene-modified polyethylene (percent modification: 20% by weight; softening point: 126° C.) | 3 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.7 μm. The ground matter was then classified to obtain a classified product having $D_{50}$ of 7.5 μm and a particle diameter distribution in which particles having a particle diameter of not more than 5 μm account for 27% of all the particles by number. The average diameter of wax particles dispersed in the particulate toner was 0.5 μm. The amount of wax exposed on the surface of the particulate toner was 60% by weight. To the toner thus obtained was then added a colloidal silica (R972, available from Nihon Aerogel Co., Ltd.) in an amount of 0–9 parts by weight based on 100 parts by weight of the toner with stirring by a Henschel mixer to obtain a toner 3.

| | |
|---|---|
| Styrene-butylacrylate copolymer (copolymerization ratio: 80:20; Mw: 125,000; MI: 11; Tg: 60° C.) | 48 parts by weight |
| Magnetic material (octahedral magnetite; average particle diameter: 0.22 μm) | 45 parts by weight |
| Negative charge controller (salicylic Cr dye) | 2 parts by weight |
| Low molecular weight polypropylene (softening point: 153° C.) | 2 parts by weight |
| Styrene-modified polyethylene (percent modification: 10% by weight; softening point: 120° C.) | 3 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 7.7 μm. The ground matter was then classified to obtain a classified product having $D_{50}$ of 8.5 μm and a particle diameter distribution in which particles having a particle diameter of not more than 5 μm account for 15% of all the particles by number. The average diameter of wax particles dispersed in the particulate toner was 0.5 μm. The amount of wax exposed on the surface of the particulate toner was 62% by weight. To the toner thus obtained was then added a colloidal silica (R972, available from Nihon Aerogel Co., Ltd.) in an amount of 0.6 parts by weight based on 100 parts by weight of the toner with stirring by a Henschel mixer to obtain a toner 4.

EXAMPLE 5

| | |
|---|---|
| Styrene-butylacrylate copolymer (copolymerization ratio: 80:20; Mw: 125,000; MI: 11; Tg: 60° C.) | 49 parts by weight |
| Magnetic material (octahedral magnetite; average particle diameter 0.22 μm) | 45 parts by weight |
| Negative charge controller (salicylic Cr dye) | 2 parts by weight |
| Low molecular weight polypropylene (softening point; 153° C.) | 2 parts by weight |
| Styrene-modified polyethylene (percent modification: 30% by weight; softening point 120° C.) | 2 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 7.9 μm. The ground matter was then classified to obtain a classified product having $D_{50}$ of 8.8 μm and a particle diameter distribution in which particles having a particle diameter of not more than 5 μm account for 13% of all the particles by number. The average diameter of wax particles dispersed in the particulate toner was 0.4 μm. The amount of wax exposed on the surface of the particulate toner was 49% by weight. To the toner thus obtained was then added a colloidal silica (R972, available from Nihon Aerogel Co., Ltd.) in an amount of 0.5 parts by weight based on 100 parts by weight of the toner with stirring by a Henschel mixer to obtain a toner 5.

EXAMPLE 6

| | |
|---|---|
| Styrene-butylacrylate copolymer (copolymerization ratio: 80:20; Mw: 125,000; MI: 11; Tg: 60° C.) | 48 parts by weight |
| Magnetic material (octahedral magnetite; average particle diameter: 0.22 μm) | 45 parts by weight |
| Negative charge controller (salicylic Cr dye) | 2 parts by weight |
| Low molecular weight polypropylene (softening point: 153° C.) | 1.5 parts by weight |
| Styrene-modified polyethylene (percent modification: 30% by weight; softening point: 120° C.) | 2 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.2 μm. The ground matter was then classified to obtain a classified product having $D_{50}$ of 7.0 μm and a particle diameter distribution in which particles having a particle diameter of not more than 5 μm account for 33% of all the particles by number. The average diameter of wax particles dispersed in the particulate toner was 0.2 μm. The amount of wax exposed on the surface of the particulate toner was 41% by weight. To the toner thus obtained was then added a colloidal silica (R972, available from Nihon Aerogel Co., Ltd.) in an amount of 0.6 parts by weight based on 100 parts by weight of the toner with stirring by a Henschel mixer to obtain a toner 6.

COMPARATIVE EXAMPLE 1

| | |
|---|---|
| Styrene-butylacrylate copolymer (copolymerization ratio: 80:20; Mw: 130,000; MI: 14; Tg: 59° C.) | 46.8 parts by weight |
| Magnetic material (octahedral magnetite; average particle diameter: 0.19 μm) | 50 parts by weight |
| Negative charge controller (azo Cr dye) | 0.7 parts by weight |
| Low molecular weight polypropylene (softening point: 148° C.) | 3 parts by weight |
| Styrene-modified polyethylene (percent modification: 30% by weight; softening point: 126° C.) | 2 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.6 μm. The ground matter was then classified to obtain a classified produce having $D_{50}$ of 7.2 μm and a particle diameter distribution in which particles having a particle diameter or not more than 5 μm account for 28% of all the particles by number. The average diameter of wax particles dispersed in the particulate toner was 0.6 μm. The amount of wax exposed on the surface of the particulate toner was 65% by weight. To the toner thus obtained was then added a colloidal silica in the same manner as in Example 1 to obtain a toner 7.

| | |
|---|---|
| Styrene-butylacrylate copolymer (copolymerization ratio; 80:20; Mw: 130,000; MI: 17; Tg: 60° C.) | 44 parts by weight |
| Magnetic material (octahedral magnetite; average particle diameter 0.22 μm) | 50 parts by weight |
| Negative charge controller (salicylic Cr dye) | 2 parts by weight |
| Low molecular weight polypropylene (softening point: 153° C.) | 2 parts by weight |
| Styrene-modified polyethylene (percent modification: 5% by weight; softening point: 120° C.) | 2 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.4 μm. The ground matter was then classified to obtain a classified product having $D_{50}$ of 7.4 μm and a particle diameter distribution in which particles having a particle diameter of not more than 5 μm account for 25% of all the particles by number. The average diameter of wax particles dispersed in the particulate toner was 0.6 μm. The amount of wax exposed on the surface of the particulate toner was 45% by weight. To the toner thus obtained was then added a colloidal silica (R972, available from Nihon Aerogel Co., Ltd.) in an amount of 1.0 part by weight based on 100 parts by weight of the toner with stirring by a Henschel mixer to obtain a toner 8.

| | |
|---|---|
| Styrene-butylacrylate copolymer (copolymerization ratio: 80:20; Mw: 130,000; MI: 14; Tg: 59° C.) | 46.3 parts by weight |
| Magnetic material (hexahedral magnetite; average particle diameter: 0.19 μm) | 50 parts by weight |
| Negative charge controller (azo Cr dye) | 0.7 parts by weight |
| Low molecular weight polypropylene (softening point: 148° C.) | 1 part by weight |
| Styrene-modified polyethylene (percent modification: 30% by weight; softening point: 126° C.) | 2 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.8 μm. The ground matter was then classified to obtain a classified product having $D_{50}$ of 7.7 μm and a particle diameter distribution in which particles having a particle diameter of not more than 5 μm account for 20% of all the particles by number. The average diameter of wax particles dispersed in the particulate toner was 0.1 μm. The amount of wax exposed on the surface of the particulate toner was 33% by weight. To the toner thus obtained was then added a colloidal silica (R972, available from Nihon Aerogel Co., Ltd.) in an amount of 1.0 part by weight based on 100 parts by weight of the toner with stirring with by a Henschel mixer to obtain a toner 9.

COMPARATIVE EXAMPLE 4

| | |
|---|---|
| Styrene-butylacrylate copolymer (copolymerization ratio: 80:20; Mw: 130,000; MI: 14; Tg: 59° C.) | 52.8 parts by weight |

-continued

| | |
|---|---|
| Magnetic material (hexahedral magnetite; average particle diameter: 0.19 μm) | 40 parts by weight |
| Negative charge controller (azo Cr dye) | 0.7 parts by weight |
| Low molecular weight polypropylene (softening point: 148° C.) | 2.5 part by weight |
| Styrene-modified polyethylene (percent modification: 30% by weight; softening point: 126° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.5 μm. The ground matter was then classified to obtain a classified product having $D_{50}$ of 7.7 μm and a particle diameter distribution in which particles having a particle diameter of not more than 5 μm account for 22% of all the particles by number. The average diameter of wax particles dispersed in the particulate toner was 0.3 μm. The amount of wax exposed on the surface of the particulate toner was 67% by weight. To the toner thus obtained was then added a colloidal silica (R972, available from Nihon Aerogel Co., Ltd.) in an amount of 1.0 part by weight based on 100 parts by weight of the toner with stirring with by a Henschel mixer to obtain a toner 10.

COMPARATIVE EXAMPLE 5

| | |
|---|---|
| Styrene-butylacrylate copolymer (copolymerization ratio; 80:20; Mw: 130,000; MI: 14; Tg: 59° C.) | 45.3 parts by weight |
| Magnetic material (hexahedral magnetite; average particle diameter 0.19 μm) | 50 parts by weight |
| Negative charge controller (azo Cr dye) | 0.7 parts by weight |
| Low molecular weight polypropylene (softening point: 148° C.) | 2 parts by weight |
| 1-Phenylenepropene-modified polyethylene (percent modification: 5% by weight; softening point: 126° C.) | 2 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.2 μm. The ground matter was then classified to obtain a classified product having $D_{50}$ of 7.0 μm and a particle diameter distribution in which particles having a particle diameter of not more than 5 μm account for 34% of all the particles by number. The average diameter of wax particles dispersed in the particulate toner was 0.7 μm. The amount of wax exposed on the surface of the particulate toner was 50% by weight. To the toner thus obtained was then added a colloidal silica (R972, available from Nihon Aerogel Co., Ltd.) in an amount of 1.2 parts by weight based on 100 parts by weight of the toner with stirring with by a Henschel mixer to obtain a toner 11.

COMPARATIVE EXAMPLE 6

| | |
|---|---|
| Styrene-butylacrylate copolymer (copolymerization ratio: 80:20; Mw: 130,000; MI: 14; Tg: 59° C.) | 45.3 parts by weight |
| Magnetic material (hexahedral magnetite; average particle diameter: 0.19 μm) | 50 parts by weight |
| Negative charge controller (azo Cr dye) | 0.7 parts by weight |
| Styrene-modified polyethylene (percent modification: 30% by weight; softening point: 126° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 8.3 μm. The ground matter was then classified to obtain a classified product having $D_{50}$ of 8.8 μm and a particle diameter distribution in which particles having a particle diameter of not more than 5 μm account for 15% of all the particles. The average diameter of wax particles dispersed in the particulate toner was 0.1 μm. The amount of wax exposed on the surface of the particulate toner was 44% by weight, To the toner thus obtained was then added a colloidal silica (R972, available from Nihon Aerogel Co., Ltd.) in an amount of 0.4 parts by weight based on 100 parts by weight of the toner with stirring with by a Henschel mixer to obtain a toner 12.

COMPARATIVE EXAMPLE 7

| | |
|---|---|
| Styrene-butylacrylate copolymer (copolymerization ratio: 80:20; Mw: 130,000; MI: 14; Tg: 59° C.) | 46.3 parts by weight |
| Magnetic material (hexahedral magnetite; average particle diameter: 0.19 μm) | 50 parts by weight |
| Negative charge controller (azo Cr dye) | 0.7 parts by weight |
| Low molecular weight polypropylene (softening point: 148° C.) | 3 part by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.3 μm. The ground matter was then classified to obtain a classified product having $D_{50}$ of 7.1 μm and a particle diameter distribution in which particles having a particle diameter of not more than 5 μm account for 31% of all the particles. The average diameter of wax particles dispersed in the particulate toner was 0.8 μm. The amount of wax exposed on the surface of the particulate toner was 58% by weight. To the toner thus obtained was then added a colloidal silica (R972, available from Nihon Aerogel Co., Ltd.) in an amount of 1.2 parts by weight based on 100 parts by weight of the toner with stirring with by a Henschel mixer to obtain a toner 13.

As developers, the toners 1 to 13 thus obtained were then evaluated in a magnetic unitary development process. In some detail, these toners were subjected to running test with about 5,000 sheets at a high temperature and high humidity (30° C., 90% RE) by means of a Type PC-PR1000 printer available from NEC. The image density was then measured. The development sleeve was then observed- Using a remodelled version of the printer, the temperature at which offset occurs was evaluated. The results are see forth in Table 1. In the table, G indicates a practically acceptable level; 220° C. or more in hot offset occurring temperature and 1.20 or more in density after 5,000 sheets. P indicates a practically unacceptable level; less than 220° C. in hot offset occurring temperature (image is deteriorated by occurrence of offset) and less than 1.20 in density after 5,000 sheets (density is apparently low with visual observation).

TABLE 1

| Example No. | Hot offset occurring temperature | Initial density* | Density* after 5,000 sheets | Condition of development sleeve |
|---|---|---|---|---|
| Example 1 | 238° C. G | 1.50 | 1.47 G | G |
| Example 2 | >240° C. G | 1.51 | 1.46 G | G |
| Example 3 | 238° C. G | 1.51 | 1.47 G | G |
| Example 4 | 240° C. G | 1.52 | 1.46 G | G |
| Example 5 | 235° C. G | 1.50 | 1.46 G | G |
| Example 6 | 233° C. G | 1.53 | 1.50 G | G |
| Comparative Example 1 | >240° C. G | 1.45 | 1.00 P | P (toner attached) |
| Comparative Example 2 | 237° C. G | 1.48 | 0.98 P | P (toner attached) |
| Comparative Example 3 | 190° C. P | 1.50 | 1.47 G | G |
| Comparative Example 4 | >240° C. G | 1.42 | 0.71 P | PP (frequently toner attached) |
| Comparative Example 5 | 230° C. G | 1.43 | 0.83 P | P (toner attached) |
| Comparative Example 6 | 185° C. P | 1.53 | 1.49 G | G |
| Comparative Example 7 | 233° C. G | 1.50 | 1.00 P | P (toner attached) |

*measured by Type X-rite 404 densitometer

EXAMPLE 7

| | |
|---|---|
| Styrene-butylacrylate copolymer (copolymerization ratio: 80:20; Mw: 130,000; MI: 14; Tg: 59° C.) | 84 parts by weight |
| Carbon black (BPL, available from Cobalt Co., Ltd.) | 8 parts by weight |
| Negative charge controller (azo Cr dye) | 1 part by weight |
| Low molecular weight polypropylene (softening point: 148° C.) | 3 parts by weight |
| Styrene-modified polyethylene (percent modification: 30% by weight; softening point: 126° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.5 μm. The ground matter was then classified to obtain a classified product having $D_{50}$ of 7.3 μm and a particle diameter distribution in which particles having a particle diameter of not more than 5 μm account for 30% of all the particles by number. The average diameter of wax particles dispersed in the particulate toner was 0.3 μm. The amount of wax exposed on the surface of the particulate toner was 42% by weight. To the toner thus obtained was then added a colloidal silica (R972, available from Nihon Aerogel Co., Ltd.) in an amount of 1.0 part by weight based on 100 parts by weight of the toner with stirring by a Henschel mixer to obtain a toner 14.

EXAMPLE 8

| | |
|---|---|
| Styrene-butylacrylate copolymer (copolymerization ratio: 80:20; Mw: 125,000; MI: 11; Tg: 60° C.) | 78 parts by weight |
| Carbon black (BPL,available from Cobalt Co., Ltd.) | 8 parts by weight |
| Negative charge controller (salicylic Cr dye) | 4 parts by weight |
| Low molecular weight polypropylene (softening point: 153° C.) | 4 parts by weight |
| Styrene-modified polyethylene (percent modification: 30% by weight; softening point: 120° C.) | 6 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 7.6 μm. The ground matter was then classified to obtain a classified product having $D_{30}$ of 8.5 μm and a particle diameter distribution in which particles having a particle diameter of not more than 5 μm account for 15% of all the particles by number. The average diameter of wax particles dispersed in the particulate toner was 0.4 μm. The amount of wax exposed on the surface of the particulate toner was 60% by weight. To the toner thus obtained were then added a colloidal silica (R972, available from Nihon Aerogel Co., Ltd.) and strontium oxide having an average particle diameter of 0.5 μm in an amount of 0.6 parts by weight and 0.5 parts based on 100 parts by weight of the toner, respectively, with stirring by a Henschel mixer to obtain a toner 15.

EXAMPLE 9

| | |
|---|---|
| Styrene-butylacrylate copolymer (copolymerization ratio: 80:20; Mw: 125,000; MI: 11; Tg: 60° C.) | 78 parts by weight |
| Carbon black (BPL,available from Cobalt Co., Ltd.) | 8 parts by weight |
| Negative charge controller (salicylic Cr dye) | 4 parts by weight |
| Low molecular weight polypropylene (softening point; 153° C.) | 4 parts by weight |
| 1-Phenylenepropene-modified polyethylene (percent modification; 20% by weight; softening point: 120° C.) | 6 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.7 μm. The ground matter was then classified to obtain a classified product having $D_{50}$ of 7.5 μm and a particle diameter distribution in which particles having a particle diameter of not more than 5 μm account for 27% of all the particles by number. The average diameter of wax particles dispersed in the particulate toner was 0.5 μm. The amount of wax exposed on the surface of the particulate toner was 62% by weight. To the toner thus obtained was then added a colloidal silica (R972, available from Nihon Aerogel Co., Ltd.) in an amount of 0.9 parts by weight based on 100 parts by weight of the toner with stirring by a Henschel mixer to obtain a toner 16.

EXAMPLE 10

| | |
|---|---|
| Styrene-butylacrylate copolymer (copolymerization ratio: 80:20; Mw: 125,000; MI: 11; Tg: 60° C.) | 78 parts by weight |
| Carbon black (BPL,available from Cobalt Co., Ltd.) | 8 parts by weight |
| Negative charge controller (salicylic Cr dye) | 4 parts by weight |
| Low molecular weight polypropylene (softening point: 153° C.) | 4 parts by weight |
| Styrene-modified polyethylene (percent modification: 10% by weight; softening point: 120° C.) | 6 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 7.7 μm. The ground matter was then classified to obtain a classified product having $D_{50}$ of 8.5 μm and a particle diameter distribution in which particles having a particle diameter of not more than 5 μm account for 15% of all the particles by number. The average diameter of wax particles dispersed in the particulate toner was 0.5 μm. The amount of wax exposed on the surface of the particulate toner was 63% by weight. To the toner thus obtained was then added a colloidal silica (R972, available from Nihon Aerogel Co., Ltd.) in an amount of 0–6 parts by weight based on 100 parts by weight of the toner with stirring by a Henschel mixer to obtain a toner 17.

EXAMPLE 11

| | |
|---|---|
| Styrene-butylacrylate copolymer (copolymerization ratio: 80:20; Mw: 125,000; MI: 11; Tg: 60° C.) | 82 parts by weight |
| Carbon black (BPL,available from Cobalt Co., Ltd.) | 8 parts by weight |
| Negative charge controller (salicylic Cr dye) | 2 parts by weight |
| Low molecular weight polypropylene (softening point: 153° C.) | 4 parts by weight |
| Styrene-modified polyethylene (percent modification: 30% by weight; softening point: 120° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 7.9 μm. The ground matter was then classified to obtain a classified product having $D_{50}$ of 8.8 μm and a particle diameter distribution in which particles having a particle diameter of not more than 5 μm account for 13% of all the particles by number. The average diameter of wax particles dispersed in the particulate toner was 0.4 μm. The amount of wax exposed on the surface of the particulate toner was 51% by weight. To the toner thus obtained was then added a colloidal silica (R972, available from Nihon Aerogel Co., Ltd.) in an amount of 0.5 parts by weight based on 100 parts by weight of the toner with stirring by a Henschel mixer to obtain a toner 18.

EXAMPLE 12

| | |
|---|---|
| Styrene-butylacrylate copolymer (copolymerization ratio: 80:20; Mw: 125,000; MI: 11; Tg: 60° C.) | 78 parts by weight |
| Carbon black (BPL,available from Cobalt Co., Ltd.) | 8 parts by weight |
| Negative charge controller (salicylic Cr dye) | 2 parts by weight |
| Low molecular weight polypropylene (softening point: 153° C.) | 4 parts by weight |
| Styrene-modified poylethylene (percent modification: 30% by weight; softening point: 120° C.) | 8 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.2 μm. The ground matter was then classified to obtain a classified product having $D_{50}$ of 7.0 μm and a particle diameter distribution in which particles having a particle diameter of not more than 5 μm account for 33% of all the particles by number. The average diameter of wax particles dispersed in the particulate toner was 0.1 μm. The amount of wax exposed on the surface of the particulate toner was 65% by weight. To the toner thus obtained was then added a colloidal silica (R972, available from Nihon Aerogel Co., Ltd.) in an amount of 0.6 parts by weight based on 100 parts by weight of the toner with stirring by a Henschel mixer to obtain a toner 19.

COMPARATIVE EXAMPLE 8

| | |
|---|---|
| Styrene-butylacrylate copolymer (copolymerization ratio: 80:20; Mw: 130,000; MI: 14; Tg: 59° C.) | 79.9 parts by weight |
| Carbon black (BPL,available from Cobalt Co., Ltd.) | 8 parts by weight |
| Negative charge controller (azo Cr dye) | 2.1 parts by weight |
| Low molecular weight polypropylene (softening point: 148° C.) | 6 parts by weight |
| Styrene-modified polyethylene (percent modification: 30% by weight; softening point: 126° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.6 μm. The ground matter was then classified to obtain a classified product having $D_{50}$ of 7.2 μm and a particle diameter distribution in which particles having a particle diameter of not more than 5 μm account for 28% of all the particles by number. The average diameter of wax particles dispersed in the particulate toner was 0.7 μm. The amount of wax exposed on the surface of the particulate toner was 65% by weight. To the toner thus obtained was then added a colloidal silica in the same manner as in Example 7 to obtain a toner 20.

COMPARATIVE EXAMPLE 9

| | |
|---|---|
| Styrene-butylacrylate copolymer (copolymerization ratio; 80:20; Mw: 130,000; MI: 17; Tg: 60° C.) | 82 parts by weight |
| Carbon black (BPL,available from Cobalt Co., Ltd.) | 8 parts by weight |
| Negative charge controller (salicylic Cr dye) | 2 parts by weight |
| Low molecular weight polypropylene (softening point 153° C.) | 4 parts by weight |
| Styrene-modified polyethylene (percent modification: 5% by weight; softening point: 120° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.4 μm. The ground matter was then classified to obtain a classified product having $D_{50}$ of 7.4 μm and a particle diameter distribution in which particles having a particle diameter of not more than 5 μm account for 25% of all the particles by number. The average diameter of wax particles dispersed in the particulate toner was 0.6 μm. The amount of wax exposed on the surface of the particulate toner was 47% by weight. To the toner thus obtained was then added a colloidal silica (R972, available from Nihon Aerogel CO., Ltd.) in an amount of 1.0 part by weight based on 100 parts by weight of the toner with stirring by a Henschel mixer to obtain a toner 21.

COMPARATIVE EXAMPLE 10

| | |
|---|---|
| Styrene-butylacrylate copolymer (copolymerization ratio: 80:20; Mw: 130,000; MI: 14; Tg: 59° C.) | 83.9 parts by weight |
| Carbon black (BPL,available from Cobalt Co., Ltd.) | 8 parts by weight |
| Negative charge controller (azo Cry dye) | 2.1 parts by weight |
| Low molecular weight polypropylene (softening point: 148° C.) | 2 parts by weight |
| Styrene-modified polyethylene (percent modification: 30% by weight; softening point: 126° C.) | 4 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.8 μm. The ground matter was then classified to obtain a classified product having $D_{50}$ of 7.7 μm and a particle diameter distribution in which particles having a particle diameter of not more than 5 μm account for 20% of all the particles by number. The average diameter of wax particles dispersed in the particulate toner was 0.1 μm. The amount of wax exposed on the surface of the particulate toner was 37% by weight. To the toner thus obtained was then added a colloidal silica (R972, available from Nihon Aerogel Co., Ltd.) in an amount of 1.0 part by weight based on 100 parts by weight of the toner with stirring by a Henschel mixer to obtain a toner 22.

COMPARATIVE EXAMPLE 11

| | |
|---|---|
| Styrene-butylacrylate copolymer (copolymerization ratio: 80:20; Mw: 130,000; MI: 14; Tg: 59° C.) | 76.9 parts by weight |
| Carbon black (BPL,available from Cobalt Co., Ltd.) | 8 parts by weight |
| Negative charge controller (azo Cr dye) | 2.1 parts by weight |
| Low molecular weight polypropylene (softening point: 148° C.) | 5 parts by weight |
| Styrene-modified polyethylene (percent modification: 30% by weight; softening point: 126° C.) | 8 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.5 μm. The ground matter was then classified to obtain a classified product having $D_{50}$ of 7.7 μm and a particle diameter distribution in which particles having a particle diameter of not more than 5 μm account for 22% of all the particles by number. The average diameter of wax particles dispersed in the particulate toner was 0.3 μm. The amount of wax exposed on the surface of the particulate toner was 70% by weight. To the toner thus obtained was then added a colloidal silica (R972, available from Nihon Aerogel Co., Ltd.) in an amount of 1.0 part by weight based on 100 parts by weight of the toner with stirring by a Henschel mixer to obtain a toner 23.

COMPARATIVE EXAMPLE 12

| | |
|---|---|
| Styrene-butylacrylate copolymer (copolymerization ratio 80:20; Mw: 130,000; MI: 14; Tg: 59° C.) | 81.9 parts by weight |
| Carbon black (BPL,available from Cobalt Co., Ltd.) | 8 parts by weight |
| Negative charge controller (azo Cr dye) | 2.1 parts by weight |
| Low molecular weight polypropylene (softening point: 148° C.) | 4 parts by weight |
| 1-Phenylpropene-modified polyethylene (percent modification: 5% by weight; softening point: 126° C.) | 4 parts by weight |

The foregoing materials were mixed in the form of powder by a Henschel mixer, and then heat-kneaded by an extruder. After cooled, the material was coarsely ground, and then finely ground Go obtain a ground matter having a 50% volume diameter $D_{50}$ of 6.2 μm. The ground matter was then classified to obtain a classified product having $D_{50}$ of 7.0 μm and a particle diameter distribution in which particles having a particle diameter of not more than 5 μm account for 34% of all the particles by number. The average diameter of wax particles dispersed in the particulate toner was 0.7 μm. The amount of wax exposed on the surface of the particulate toner was 53% by weight. To the toner thus obtained was then added a colloidal silica (R972, available from Nihon Aerogel Co., Ltd.) in an amount of 1.2 parts by weight based on 100 parts by weight of the toner with stirring by a Henschel mixer to obtain a toner 24.

COMPARATIVE EXAMPLE 13

| | |
|---|---|
| Styrene-butylacrylate copolymer (copolymerization ratio: 80:20; Mw: 130,000; MI: 14; Tg: 59° C.) | 81.9 parts by weight |
| Carbon black (BPL,available from Cobalt Co., Ltd.) | 8 parts by weight |
| Negative charge controller (azo Cr dye) | 2.1 parts by weight |
| Styrene-modified polyethylene (percent modification; 30% by weight; softening point: 126° C.) | 8 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 8.3 μm. The ground matter was then classified to obtain a classified product having $D_{50}$ of 8.8 μm and a particle diameter distribution in which particles having a particle diameter of not more than 5 μm account for 15% of all the particles by number. The average diameter of wax particles dispersed in the particulate toner was 0.1 μm. The amount of wax exposed on the surface of the particulate toner was 46% by weight. To the toner thus obtained was then added a colloidal silica (R972, available from Nihon Aerogel Co., Ltd.) in an amount of 0.4 parts by weight based on 100 parts by weight of the toner with stirring by a Henschel mixer to obtain a toner 25.

COMPARATIVE EXAMPLE 14

| | |
|---|---|
| Styrene-butylacrylate copolymer (copolymerization ratio: 80:20; Mw; 130,000; MI: 14; Tg: 59° C.) | 83.9 parts by weight |
| Carbon black (BPL,available from Cobalt Co., Ltd.) | 8 parts by weight |
| Negative charge controller (azo Cr dye) | 2.1 parts by weight |
| Low molecular weight polypropylene (softening point: 148° C.) | 6 parts by weight |

The foregoing materials were mixed in the form of powder by a Henschel mixer, and then heat-kneaded by an extruder. After cooled, the material was coarsely ground, and then finely ground to obtain a ground matter having a 50% volume diameter $D_{50}$ of 6.3 μm. The ground matter was then classified to obtain a classified product having $D_{50}$ of 7.1 μm and a particle diameter distribution in which particles having a particle diameter of not more than 5 μm account for 31% of all the particles by number. The average diameter of wax particles dispersed in the particulate toner was 0.9 μm. The amount of wax exposed on the surface of the particulate toner was 60% by weight. To the toner thus obtained was then added a colloidal silica (R972, available from Nihon Aerogel Co., Ltd.) in an amount of 1.2 parts by weight based on 100 parts by weight of the toner with stirring by n Henschel mixer to obtain a toner 26.

These toners 14 to 26 were then used as developers in the binary development process. The carrier used in this process had been prepared as follows.

(Preparation of carrier)

A ferrite core containing amorphous, tabular and spherical Cu—Zn particles having a particle diameter of 80 μm was coated with a 80:20 copolymer of vinylidene fluoride and hexafluoropropylene. In some detail, 80% by weight of the foregoing copolymer was added to the core material in the presence of dimethyl formamide as a solvent (percent coating: 3%). The core material thus coated was then dried at a temperature of 130° C. to obtain a carrier.

The foregoing toners 14 to 26 were each mixed with the carrier thus obtained in a proportion of 5:100 to prepare a nonmagnetic binary developer. The developer was then subjected to running test with about 5,000 sheets at a high temperature and high humidity (30° C., 90% RH) by a color developing apparatus in a duplicating machine (Able 1301α (remodelled version), available from Fuji Xeorx Co., Ltd.). In this running test, the image density was measured. Further, the extent of wax migration to carrier was observed. Moreover, the temperature at which offset occurs was evaluated. The results are set forth in Table 2. In Table 2, an evaluation using G and P is the same as previously explained in Table 1.

TABLE 2

| Example No. | Hot offset occurring temperature | Initial density* | Density* after 5,000 sheets | Wax migration to carrier |
|---|---|---|---|---|
| Example 7 | 231° C. G | 1.49 | 1.47 G | G |
| Example 8 | >240° C. G | 1.53 | 1.49 G | G |
| Example 9 | 236° C. G | 1.50 | 1.49 G | G |
| Example 10 | 232° C. G | 1.55 | 1.53 G | G |
| Example 11 | 239° C. G | 1.50 | 1.48 G | G |
| Example 12 | 230° C. G | 1.51 | 1.47 G | G |
| Comparative Example 8 | >240° C. G | 1.49 | 1.18 P | P (wax attached) |
| Comparative Example 9 | 234° C. G | 1.48 | 0.77 P | P (wax attached) |
| Comparative Example 10 | 197° C. P | 1.53 | 1.48 G | G |
| Comparative Example 11 | >240° C. G | 1.48 | 0.79 P | PP (frequently wax attached) |
| Comparative Example 12 | 232° C. G | 1.43 | 0.88 P | P (wax attached) |
| Comparative Example 13 | 182° C. P | 1.50 | 1.46 G | G |
| Comparative Example 14 | 236° C. G | 1.51 | 1.08 P | P (wax attached |

*measured by Type X-rite 404 densitometer

In accordance with the foregoing constitution of the present invention, the mixing ratio of polyolefin wax and modified polyolefin wax, the average diameter of wax particles dispersed in the toner, and the amount of wax on the surface of the toner are properly controlled to inhibit the filming of wax on the development sleeve and photoreceptor. In this arrangement, a toner for developing an electrostatic image can be obtained which exhibits an excellent releasability from the heat roller, an excellent development stability with time and a practically sufficiently wide fixing latitude. Accordingly, the image formation process with the toner for developing an electrostatic image of the present invention makes it possible to form a copied image with an excellent dot reproducibility, fine line reproducibility and gradation.

While the invention has been described in detail and with reference to specific embodiments thereof, it will be apparent to one skilled in the art that various changes and modifications can be made therein without departing from the spirit and scope thereof.

What is claimed is:

1. A toner for developing an electrostatic image, which comprises a particulate toner containing a polyolefin wax and a modified polyolefin wax, wherein said polyolefin wax is low number average molecular weight polyethylene or low number average molecular weight polypropylene having a softening point of from 80° C. to 160° C. and said modified polyolefin wax is mainly composed of a low number average molecular weight polyethylene with $M_n$ being 1,000 to 15,000, wherein the average diameter of wax particles dispersed in said particulate toner is not more than 0.5 μm and the amount of wax exposed on the surface of said particulate toner is from 40 to 65% by weight, and wherein a modifying component used in said modified polyolefin wax is an aromatic vinyl monomer, an acrylate monomer, an unsaturated dicarboxylic acid ester, or a mixture thereof.

2. The toner for developing an electrostatic image according to claim 1, wherein said particulate toner comprises a finely divided magnetic powder.

3. The toner for developing an electrostatic image according to claim 2, wherein the content of said finely divided magnetic powder is from 30 to 70% by weight based on the total weight of the particulate toner.

4. The toner for developing an electrostatic image according to claim 1, which satisfies the relationship $WH \geqq WP$ where WP (wt. %) is the content of polyolefin wax in said particulate toner and WH is the content of modified polyolefin wax in said particulate toner.

5. The toner for developing an electrostatic image according to claim 1, wherein said polyolefin wax is a low number average molecular weight polypropylene with $M_n$ being 1,000 to 10,000.

6. The toner for developing an electrostatic image according to claim 1, wherein the percent modification in said modified polyolefin wax is from 3 to 50% by weight based on the weight of the polyolefin wax.

7. An image formation process which comprises a step of forming an electrostatic latent image on a latent image carrier, a step of developing said electrostatic latent image with a developer, a step of transferring a toner image thus formed onto a transfer medium, and a step of heat-fixing said toner image on said transfer medium, characterized in that said developer comprises a particulate toner containing a polyolefin wax and a modified polyolefin wax, wherein said polyolefin wax is low number average molecular weight polyethylene or low number average molecular weight polypropylene having a softening point of from 80° C. to 160° C. and said modified polyolefin wax is mainly composed of a low number average molecular weight polyethylene with $M_n$ being 1,000 to 15,000, wherein the average diameter of wax particles dispersed in said particulate toner is not more than 0.5 μm and the amount of wax exposed on the surface of said particulate toner is from 40 to 65% by weight, and wherein a modifying component used in said modified polyolefin wax is an aromatic vinyl monomer, an acrylate monomer, an unsaturated dicarboxylic acid ester, or a mixture thereof.

* * * * *